US005139905A

United States Patent [19]

Legere-Krongauz

[11] Patent Number: 5,139,905

[45] Date of Patent: Aug. 18, 1992

[54] PHOTOHARDENABLE ELECTROSTATIC MASTER CONTAINING A CONDUCTIVE SEALANT LAYER

[75] Inventor: Carolyn C. Legere-Krongauz, Claymont, Del.

[73] Assignee: E. I. Du Pont de Nemours and Company, Wilmington, Del.

[21] Appl. No.: 592,175

[22] Filed: Oct. 9, 1990

[51] Int. Cl.[5] ..... G03G 5/026

[52] U.S. Cl. ..... 430/49; 430/281; 430/283

[58] Field of Search ..... 430/49, 66, 67, 281, 430/283

[56] References Cited

U.S. PATENT DOCUMENTS

| | | | |
|---|---|---|---|
| 4,732,831 | 3/1988 | Riesenfeld et al. | 430/49 |
| 4,911,999 | 3/1990 | Legere | 430/49 |
| 4,960,660 | 10/1990 | Dubin | 430/49 |

*Primary Examiner*—John Goodrow

[57] ABSTRACT

A photohardenable electrostatic master comprising an electrically conductive substrate; a photohardenable layer, and a conductant sealant layer, the conductant being a thiourea or a thioamide present in an amount sufficient to control the discharge characteristics of the sealant layer. The master is particularly useful in the graphic arts field, especially in the area of color proofing wherein proof are prepared to simulate the images produced by printing.

22 Claims, No Drawings

PHOTOHARDENABLE ELECTROSTATIC MASTER CONTAINING A CONDUCTIVE SEALANT LAYER

FIELD OF THE INVENTION

This invention relates to a photohardenable element for use as an electrostatic master. More particularly this invention relates to a photohardenable electrostatic master comprising an electrically conductive substrate; a photohardenable layer, and a sealant layer comprising a conductant.

BACKGROUND OF THE INVENTION

The xeroprinting process employs a printing plate, commonly referred to as a "master", made by creating a pattern of insulating material, i.e., an image, on the surface of a grounded conductive substrate. The master is exposed to an electrostatic field, e.g., by a corona discharge, that imposes an electrostatic charge on the surface of the master. That portion of the master bearing the insulating material retains the charge, while the charge on the remainder of the master is discharged through the grounded conductive substrate. A latent image of electrostatic charge is formed on the insulating material. The image is subsequently developed with oppositely charged particles commonly referred to as a "toner". The toner is transferred, e.g., by electrostatic or other means, to another surface, e.g., a paper or polymeric film, where it is fused, i.e., fixed, to reproduce the image of the master. Since the insulating material is permanent, or at least persistent, multiple copies can be made by repeating the charging, toning, and transfer steps.

Riesenfeld et al., U.S. Pat. No. 4,732,831, discloses an improved xeroprinting process that employs a master having a photohardenable coating on a conductive substrate. The coating contains an organic polymeric binder, an ethylenically unsaturated monomer, and a photoinitiator system. When the master is imagewise exposed to actinic radiation, the exposed regions polymerize. These exposed regions exhibit significantly higher resistance than the unexposed regions. When the exposed master is used in a xeroprinting process, the polymerized regions hold electrical charge and are developed by toner. The unpolymerized regions discharge to ground through the conductive backing and, therefore, do not attract toner.

Liquid electrostatic toners or developers, which employ high-purity isoparaffinic hydrocarbons as the liquid, can be used in xeroprinting processes. If the unpolymerized monomer present in the master is soluble in the liquid, it will be leached from the unexposed regions as multiple copies are produced. These regions will become insulating due to removal of the monomer. Consequently, copy quality will deteriorate with each succeeding copy.

Research Disclosure 294, 29464 (October, 1988) discloses that triethanolamine triacrylate and diethanolaniline diacrylate are not readily leached by isoparaffinic hydrocarbon solvents. However, this approach requires that specialized monomers be prepared. Detig et al., U.S. Pat. No. 4,859,557, discloses a photopolymer master in which the photopolymer material is protected by a transparent overcoat material whose surface is hard and has low friction. The transparent overcoat is not conducting so only low resolution images (4 to 5.6 line pairs per mm) were obtained.

A need exists for a high resolution, photohardenable electrostatic master from which multiple copies can be produced without deterioration of copy quality and which can be prepared from readily available monomers.

SUMMARY OF THE INVENTION

In accordance with this invention there is provided a high resolution, photohardenable electrostatic master comprising, in order (1) an electrically conductive substrate;

(2) a photohardenable layer; and (3) a sealant layer consisting essentially of a base polymer and a conductant compound selected from the group consisting of a thiourea and a thioamide conductant, said conductant compound being present in sufficient amount to control the discharge characteristics of said sealant layer, such that, following charging of said sealant layer, regions of said sealant layer supra to unexposed regions of said photohardenable layer discharge while regions of said sealant layer supra to exposed regions of said photohardenable layer do not discharge.

DETAILED DESCRIPTION OF THE INVENTION

The invention is an improved high resolution, photohardenable electrostatic master suitable for use in a xeroprinting process and capable of producing multiple copies without deterioration of copy quality. The invention comprises an electrically conductive substrate, a photohardenable layer, and a sealant layer containing a base polymer and a thiourea or thioamide conductant.

SEALANT LAYER

Liquid electrostatic developers, which employ high-purity isoparaffinic hydrocarbons as the liquid or solvent, are used in the xeroprinting process. Many of the monomers useful in the photohardenable composition are soluble in these hydrocarbons, especially in a preferred liquid Isopar ®-L, a mixture of branched-chain aliphatic hydrocarbons (bp 188°-206° C.). Repeated toning to make multiple copies can deteriorate the electrical properties of the master by extraction of unpolymerized monomer from unexposed areas. As monomer is extracted from the unexposed areas, the conductivity of these areas decreases. These areas begin to pick up developer particles, increasing the background in the final image.

The leaching of monomer may be prevented by coating a protective layer on top of the photohardenable layer. However, if the protective layer is insulating, charge will not dissipate from the unexposed regions of the master. The areas of the protective layer on top of the unexposed regions will pick up developer, with resultant loss in image quality. If the protective layer is totally conducting, the entire surface will discharge and no image will be formed. Therefore, the protective layer must contain a conductant which will cause imagewise charge decay. That is, only those regions of the protective layer supra to unexposed regions of the master discharge, while those regions of the protective layer supra to exposed regions of the master do not discharge.

Thioureas and thioamides act as conductants when added to the polymeric sealant layer in an amount sufficient to control the charge decay characteristics of the sealant layer. Surprisingly, incorporation of these materials into the sealant layer does not cause the entire surface to discharge. Imagewise discharge only occurs, i.e., only the regions of the sealant layer supra to unexposed regions of the master discharge. Image quality is maintained when the sealant layer of this invention is added to the photohardenable electrostatic master.

Thioureas which are useful are compounds of the following general structure:

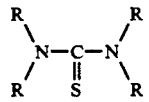

in which the R groups may be the same or different, and may be hydrogen or alkyl, typically up to about 6 carbon atoms; cycloalkyl, typically of 5 to 7 carbon atoms; or aryl, of 6 to 10 carbon atoms. Representative thioureas containing one or more alkyl substituents are: 1-allyl-2-thiourea; 1,3-dibutyl-2-thiourea; 1-ethyl-2-thiourea; and glyoxaldithiosemicarbazone. A representative thiourea having a cycloalkyl substituent is 1-cyclohexyl-3-(2-morpholinoethyl)-2-thiourea. Diphenyl thiourea, also known as thiocarbanilide is a representative thiourea having aryl substituents. A preferred thiourea is allyl thiourea, e.g., 1-allyl-2-thiourea.

Another class of thiourea compounds that may be used to advantage are the alkylated and unalkylated thioenols of thioureas. A representative thioenol of a thiourea is 3,4,5,6-tetrahydropyrimidine-2-thiol. Salts of thioureas may also be used. The hydroiodide salt of 2-methylthio-2-imidazoline is a representative salt.

Thioamide compounds that are useful will generally have similar structures to the thiourea compounds described above, except that only a single nitrogen is affixed to the thiocarbonyl moiety. Thus, thioamides will have the following general structure:

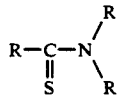

in which the R groups can be the same or different, and may have the substituents previously described above for thioureas. A representative thioamide is an aminobutenethioamide, e.g., 3-amino-2-butenethioamide, etc.

These compounds are readily prepared by conventional synthetic methods. One method for preparing a thiourea, for example, is by the reaction of an isothiocyanate with either ammonia or with a primary or secondary amine.

The conductant is present in an amount effective to increase the electrostatic decay rate or discharge characteristics of the sealant layer. In general, it is desirable to have those regions of the sealant layer which are not intended to be toned discharge in two seconds, or less, to a voltage which will not attract toner, i.e., to 5 volts or less. The amount of conductant needed to achieve this result will vary with the particular compound selected. In general, it is desirable to use the lowest practical concentration of conductant that produces acceptable charge decay from these regions. Lower levels of addition are desirable since higher levels may cause undesired discharge of adjacent regions which are intended to be toned. In general, 0.1–5% by weight, preferably 0.2–0.5% by weight of conductant may be used to advantage. The sealant layer is generally about 0.001 to about 0.008 millimeters in thickness, preferably, 0.002 to 0.004 millimeters, thick. The coating should be uniform.

Conventional organic polymeric binders, especially those which are suitable for use in the photohardenable layer, may be used as the base polymer. Examples of these base polymers include: polymers and copolymers of methyl methacrylate; cellulose esters; and polyvinyl esters and acetals, etc. It is often convenient to use the same polymer in as both the base polymer in the sealant layer and as the binder in photohardenable layer.

Preferably, the sealant layer also contains a plasticizer to enhance charge decay. Conventional plasticizers may be used provided that they are not readily leached from the sealant layer by the developer liquid and do not adversely affect the electrical properties of the master. The monomer used in the photohardenable layer may also be used as the plasticizer in the sealant layer. Since there is no initiator in the sealant layer, the monomer in the sealant layer will not polymerize when the master is irradiated to actinic radiation for the photohardenable layer. In general, 5–50% by weight, preferably 20–40% by weight, of plasticizer will be present when plasticizer is used.

PHOTOHARDENABLE LAYER

Materials with ethylenically unsaturated groups which are photopolymerizable, photocrosslinkable, and/or photodimerizable, are used in the photohardenable layer, and are "photohardenable" within the meaning of this application. The preferred photosensitive compositions comprise a polymeric binder, an addition polymerizable ethylenically unsaturated monomer, e.g., having at least two terminally unsaturated groups, and a photoinitiator or photoinitiator system. The preferred compositions also contain a charge decay additive. Other components which are conventional components of photohardenable systems may also be present.

The initiator system comprises one or more compounds which furnish free-radicals when activated by actinic radiation. It can also comprise a plurality of compounds, one of which yields free-radicals after having been caused to do so by another compound, or sensitizer, which has been activated by actinic radiation.

Numerous conventional initiator systems may be used provided they do not affect the electrical properties required for the operation on the master. Preferred initiator systems are 2,4,5-triphenylimidazolyl dimers in combination with hydrogen donors or chain transfer agents. Preferred HABI's (hexaarylbisimidazoles) are 2-o-chlorosubstituted hexaphenylbisimidazoles in which the other positions on the phenyl radicals are unsubstituted or substituted with chloro, methyl or methoxy. These compounds are disclosed in Dessauer, U.S. Pat. No. 4,252,887, the disclosure of which is incorporated herein by reference. The most preferred initiators include CDM-HABI, i.e., 2-(o-chlorophenyl)-4,5-bis(m-methoxyphenyl)-imidazole dimer; o-Cl-HBI, i.e., 1,1'-biimidazole, 2,2'-bis(o-chlorophenyl)-4,4,'5,5'-tetraphenyl-; and TCTM-HABI, i.e., 1H-imidazole, 2,5-bis(o-chlorophenyl)-4-[3,4-dimethoxyphenyl]-, dimer.

Hydrogen donor compounds useful in the photopolymer compositions include: 2-mercaptobenzoxazole, 2-mercaptobenzothiazole, 4-methyl-4H-1,2,4,triazole-3-thiol, and the like. A preferred hydrogen donor is 2-mercaptobenzoxazole.

Useful sensitizers are the bis(p-dialkylaminobenzylidene) ketones disclosed in Baum and Henry, U.S. Pat. No. 3,652,275, the arylyidene aryl ketones disclosed in Dueber, U.S. Pat. No. 4,162,162, as well as in U.S. Pat. Nos. 4,268,667 and 4,351,893, and compounds disclosed in Monroe, EPO Application 89 113810, the disclosures of which are incorporated herein by reference. These compounds extend the sensitivity of the initiator system to visible wavelengths where lasers emit. More preferred sensitizers are DMJDI, i.e., 1H-Inden-1-one, 2,3-dihydro-5,6-dimethoxy-2-[(2,3,6,7-tetrahydro-1H,5H-benzo[i,j]-quinolizin-9-yl)methylene]-, and JAW, i.e., cyclopentanone, 2,5-bis[(2,3,6,7-tetrahydro-1H,5H-benzo[i,j]quinolizin-9-yl)methylene]-.

"Monomer" includes simple monomers as well as polymers, usually of molecular weight below 1500, having ethylenic groups capable of crosslinking or addition polymerization. Numerous conventional monomers may be used provided they do not adversely affect the electrical properties needed for operation of the master. If the conductivity of the monomer is too high, charge will be lost from the unexposed area too rapidly for the toning and transfer steps to occur. Thus, it is desirable to use a monomer with a resistivity in the range of about $10^5$ to $10^9$ ohm.cm.

Preferred monomers are di-, tri-, and tetraacrylates and methacrylates such as ethylene glycol diacrylate, diethylene glycol diacrylate, triethylene glycol diacrylate, glycerol diacrylate, trimethylolpropane triacrylate, the bis-acrylates and bis-methacrylate of polyethylene glycols of molecular weight 100-500, and the like. Especially preferred monomers are ethoxylated trimethylolpropane triacrylates and polyethylene glycol 200 dimethacrylate.

The binder must have sufficiently high resistivity that charge will decay more slowly in the exposed areas than in the unexposed areas. On the other hand, if the binder resistivity is too high, the exposed area discharge rate may be too slow, resulting in overtoning of solids and over-filling of large dots. Also, unexposed area discharge rate may be too slow, reducing the speed at which multiple copies can be printed. Therefore, the binder should have a resistivity of about $10^{14}$ to $10^{20}$ ohm.cm.

Many conventional binders, such as: polymers and copolymers of methyl methacrylate; cellulose esters; and polyvinyl esters and acetals; are suitable for use in the electrostatic master. Preferred binders are poly(styrene/methyl methacrylate) and poly(methyl methacrylate).

Decay additives may be added to increase the rate of charge decay from the unpolymerized areas of the photohardenable layer. As described in Blanchet-Fincher et al., U.S. Pat. No. 4,818,660, charge decay from the unpolymerized areas can be enhanced by addition of a basic dye, a leuco dye salt of the basic dye or an azo dye salt. As described in Blanchet-Fincher et al., U.S. Pat. No. 4,849,314, the conductivity of both the exposed areas and unexposed areas can be controlled by addition of a compound which is either an electron donor or an electron acceptor. A preferred electron donor is triphenyl amine; a preferred electron donor is biphenyl. In Legere, U.S. Pat. No. 4,911,999, thiourea and thioamide charge decay additives are disclosed. A preferred charge decay additive is allyl thiourea. The pertinent disclosures of the above United States patents are incorporated herein by reference.

The photohardenable composition may also contain conventional additives, such as stabilizers, anti-halation agents, optical brightening agents, release agents, surfactants, plasticizers, etc., provided they do not affect the electrical properties required for the operation on the master. A conventional thermal polymerization inhibitor will normally be present to increase the storage stability of the photohardenable composition. The dinitroso dimers described in Pazos, U.S. Pat. No. 4,168,982, the disclosure of which is incorporated herein by reference, are also useful. A preferred stabilizer is TAOBN, i.e., 1,4,4-trimethyl-2,3-diazobicyclo-(3.2.2)-non-2-ene-N,N-dioxide. An optical brightening agent may be used to produce an image which is free from distortion due to halation. Suitable optical brighteners and ultraviolet absorbing materials are disclosed U.S. Pat. Nos. 2,784,183; 3,664,394; and 3,854,950, the disclosures of which are incorporated herein by reference.

The proportions of components used in the photohardenable composition will depend upon the particular compounds selected for each component and the application for which the photohardenable master is intended. For example, a high conductivity monomer can be used in smaller amount than a low conductivity monomer, since the former will be more efficient in eliminating charge from unexposed areas.

In general, it is desirable that regions of the photohardenable master that are not intended to be toned discharge in two seconds or less to voltage levels that will not affect toner, i.e., to 5 volts or less. The amount of decay additive needed to achieve this result will vary with the particular additive selected. In general, it is preferred to use the lowest practical concentration of decay additive which produces acceptable charge decay in the unpolymerized regions of the master to reduce any potential adverse affects on the other properties of the master. Also lower levels of addition are desirable since, in some cases, high levels may tend to cause undesired discharge in regions of the master where toning was intended. A thiourea or thioamide decay additive, for example, is generally present at about 0.1–5%, preferably about 0.2–0.5%. Concentrations as high as 5%, or more, may be required for other decay additives.

The amount of initiator, typically HABI, or initiator system will depend upon film speed requirement. Systems with HABI content above about 10% by weight provide films of high sensitivity (high speed) and can be used with laser imaging in recording digitized information, as in digital color proofing. For analog applications, e.g., exposure through a negative, film speed requirement depends upon mode of exposure. If the exposure device is a flat-bed type, in which a negative is placed over the photohardenable matrix, a 30 second or greater exposure can be used and a slow film will be acceptable. For a drum exposure device, with a collimated source of radiation, the exposure period will be brief and a higher speed film is used.

CONDUCTIVE SUBSTRATE

The substrate should be uniform and free of defects such as pinholes, bumps, and scratches. It can be a support, such as paper, glass, synthetic resin and the like, which has been coated by vapor deposition or sputtering chemical deposition on one or both sides with a metal, conductive metal oxide, or metal halide, such as aluminized polyethylene terephthalate; or a conductive paper or polymeric film. Then the coated substrate can be mounted directly on a conductive support on the printing device.

Alternatively, the substrate can be a non-conducting film, preferably a release film such as polyethylene or polypropylene. After removal of the protective release film, the film can then be laminated to the conductive support on the printing device with the tacky, photohardenable layer adjacent to the support. The substrate then acts as a coversheet which is removed after exposure but prior to charging. This is preferable because it is difficult to mount an aluminized polyester film as a support without inducing defects, for example, air pockets.

As another alternative, the conductive support may be a metal plate, such as aluminum, copper, zinc, silver or the like; or a support which has been coated with a polymeric binder containing a metal, conductive metal oxide, metal halide, conductive polymer, carbon, or other conductive filler.

COATING

The photohardenable layer is prepared by mixing the ingredients of the photohardenable composition in a suitable solvent, such as dichloromethane, etc., usually in the weight ratio of about 15:85 to 25:75 (solids to solvent), coating the mixture on the substrate, and evaporating the solvent. Photohardenable coatings should be uniform and typically have a thickness of about 3 to 15 μm, preferably about 7 to 12 μm, when dry. Dry coating weight should be about 30 to 150 mg/dm$^2$, preferably 70 to 120 mg/dm$^2$. Preferably a release film will be placed over the coating of photohardenable composition after the solvent evaporates.

ELECTRICAL CHARACTERISTICS

To evaluate and compare potential decay agents, voltage is measured on the unexposed photohardenable layer within 1 second after charging using standard conditions of charging and measuring as described in the Examples below.

The desired electrical properties of the photohardenable master are dependent on the charge deposited on the photosensitive surface and the electrical characteristics of the developer employed. Ideally, at the time of contact with the developer, the voltage in the exposed areas (VTe) should be at least 10 V, preferably at least 100 V, more than that of the of the voltage in unexposed areas (VTu).

Best results are obtained when VTu has decayed to zero or near zero. Depending on the choice of developer, VTe should be at least 10 V, preferably at least 150 V, and even up to 400 V or higher. VTu is preferably zero or near zero. If VTu is greater than 5 V, an unacceptable background is generally produced in the unexposed areas due to the acceptance and transfer of developer particles by the residual charge in the unexposed areas. An ideal time for developer application is between 5 and 15 seconds after charging.

EXPOSURE/CHARGING/TONING/TRANSFER

To provide the required conductivity differential, exposure must be sufficient to cause substantial polymerization in exposed areas. Exposing radiation can be modulated by either digital or analog means. Analog exposure utilizes a line or half-tone negative or other pattern interposed between the radiation source and film. For analog exposure an ultraviolet light source is preferred, since the unsensitized photohardenable composition is most sensitive to shorter wavelength light. Digital exposure may be carried out by a computer controlled, visible light-emitting laser which scans the film in raster fashion. For digital exposure a high speed film, i.e., one which contains a high level of photoinitiator such as HABI and which has been sensitized to longer wavelengths with a sensitizing dye, is preferred.

The preferred charging means is corona discharge. Other charging methods, e.g., discharge of a capacitor, can also be used. Any electrostatic liquid developer and any method of developer application can be used. Liquid developers, i.e., a suspension of pigmented resin toner particles in a dispersant liquid, are preferred. The dispersant liquids normally used are branched-chain aliphatic hydrocarbons with boiling points between 150° C. and 250° C. Preferred resins, having an average particle size of less than 10 μm include: copolymers of ethylene and α,β-ethylenically unsaturated acid selected from the group consisting of acrylic acid and methacrylic acid, copolymers of ethylene (80 to 99.9%)/acrylic acid or methacrylic acid (20 to 0%)/ester of methacrylic or acrylic acid (0 to 20%).

After the application of developer, the developed image is transferred to another surface, such as paper (which is particularly useful for making proofs), polymeric film, cloth, or other substrates. Transfer is generally accomplished by electrostatic techniques known in the art, but other means may be employed if so desired. It is preferred to transfer the image across a gap greater than 6 μm.

INDUSTRIAL APPLICABILITY

The photohardenable electrostatic master is particularly useful in the graphic arts field, especially in the area of color proofing wherein the proofs prepared duplicate the images produced by printing. This is accomplished by controlling the gain of the reproduced halftone dots through control of the electrical conductivity of the exposed and unexposed areas of the photohardenable electrostatic master. Since the voltage retained by the halftone dots is almost linearly related to the percent dot area, the thickness of the liquid electrostatic developer will be constant everywhere on the image, independent of the particular dot pattern to be developed. Other uses for the photohardenable master include preparation of printed circuit boards, resists, soldermask, and photohardenable coatings.

EXAMPLES

The advantageous properties of this invention can be observed by reference to the following examples which illustrate, but do not limit, the invention. The parts and percentages are by weight.

| Glossary | |
|---|---|
| ATU | 1-Allyl-2-thiourea; CAS 109-57-9 |
| o-Cl-HABI | 1,1'-Biimidazole, 2,2'-bis[o-chlorophenyl]-4,4',5,5'-tetraphenyl-; CAS 1707-68-2 |
| DMJDI | 1H-Inden-1-one, 2,3-dihydro-5,6-dimethoxy-2-[(2,3,6,7-tetrahydro-1H,5H-benzo[i,j]-quinolizin-9-yl)methylene]-; CAS 80867-05-6 |
| ETU | Ethyl thiourea; CAS 625-53-6 |
| Igepal ® CA-210 | 4-$(C_9H_{19})C_6H_4(OCH_2CH_2)_2OH$; CAS 9016-45-9; Aldrich, Milwaukee, WI |

-continued

| Glossary | |
|---|---|
| Isopar ®-L | Branched-chain aliphatic hydrocarbons, bp 188–206° C.; Exxon, Houston, TX |
| MBO | 2-Mercaptobenzoxazole; CAS 2382-96-9 |
| PSMMA | 70/30 Poly(styrene/methyl methacrylate) |
| TAOBN | 1,4,4-Trimethyl-2,3-diazobicyclo(3.2.2)-non-2-ene-2,3-dioxide |
| TCTM-HABI | 1H-Imidazole, 2,5-bis[o-chlorophenyl]-4-[3,4-dimethoxyphenyl]-, dimer; CAS 79070-04-5 |
| TMPEOTA | Triacrylate ester of ethoxylated trimethylolpropane; CAS 28961-43-5 |
| Elvacite ®2014 | Copolymer of methacrylate, acrylate, acid containing terpolymer, E. I. du Pont de Nemours and Company, Wilmington, DE |
| Elvacite ®E26598 | Poly(ethyl methacrylate); E. I. du Pont de Nemours and Company Wilmington, DE |
| TLA-454 | Tris(p-diethylamino-o-tolyl)methane |
| p-TSA | Para-toluene sulfonic acid, T3, 592-O; Milwaukee, WI |
| TPA | Triphenylamine, T8,120-5, Aldrich, Wilwaukee, WI |

GENERAL PROCEDURES

Preparation of the Master. The photohardenable composition was dissolved in dichloromethane (about 20% by weight solids) and coated onto the metallized side of 100 μm thick aluminized polyethylene terephthalate film using a 100 μm doctor knife. Coating speed was 4 cm/second. Coating temperature was 80° C. The film was dried in an oven at 80° C. for 2 minutes. Then a polyethylene release film was laminated to the master.

Preparation and Application of Sealant Layers. The following sealant layers were prepared:

Sealant Layer A: PSMMA (32.4 g, 64.8%), TMPEOTA (17.5 g, 35.0%), and ATU (0.1 g, 0.2%) in 500 g of dichloromethane.

Sealant Layer B: PSMMA (32.4 g, 64.9%), TMPEOTA (17.5 g, 35.0%), and ATU (0.05 g, 0.1%) in 500 g of dichloromethane.

Sealant Layer C: PSMMA (32.4 g, 64.7%), TMPEOTA (17.5 g, 35.0%), and ATU (0.15 g, 0.3%) in 500 g of dichloromethane.

Sealant Layer D: PSMMA (32.4 g, 64.8%), Igepal ® CA-210 (17.5 g, 35.0%), and ATU (0.1 g, 0.2%) in 500 g of dichloromethane.

Sealant Layer E: Elvacite ® 2014 (44.9 g, 89.8%), PSMMA (5 g, 10.0%), and ATU (0.1 g, 0.2%) in 500 g of dichloromethane.

Sealant Layer F: PSMMA (32.5 g, 65%), TMPEOTA (17 g, 34%), and ETU (0.5 g, 1%) in 500 g of dichloromethane.

Sealant Layer G: PSMMA (32.5 g, 65%), TMPEOTA (17.5 g, 35%), in 500 g of dichloromethane (no conductant compound present).

Application. The polyethylene release film was removed. The sealant composition was dissolved in dichloromethane (about 10% solids) and coated onto the photohardenable layer using a doctor knife. Coating was at 4 cm/second at a temperature of 80° C. A thickness of about 2.5 to 13 μm was obtained. Then a polyethylene release film was laminated on top of the sealant layer.

Exposure. Unless otherwise indicated the master was exposed through a separation negative using a Douthitt Option X Exposure Unit (Douthitt Corp., Detroit, Mich.), equipped with a model TU 64 Violux ® 5002 lamp assembly (Exposure Systems Corp., Bridgeport, Conn.) and model No. 5027 photopolymer type lamp. Exposure was about 3-7 mJ/cm$^2$. The master was exposed with the polyethylene release film in place. It was removed after exposure.

Printing. The exposed master was mounted on a drum surface. SWOP (Specification Web Offset Publications) density in the solid regions was obtained by charging the fully exposed regions of the photohardenable layer to 100 to 200 V. The charged latent image was then developed with a liquid electrostatic developer, or toner, using a two roller toning station and the developer layer properly metered. The developing and metering stations were placed at 5 and 6 o'clock respectively. The developed image was corona transferred onto paper using 50-150 microA transfer corona and 4.35 to 4.88 kV, and -2.5 to -4.0 kV tackdown roll voltage at a speed of 2.2 in/second (5.59 cm/sec) and fused in an oven for 10 seconds at 100° C.

Image Evaluation. The dot gain curves were measured using a programmable MacBeth densitometer, Model #RD 918 (MacBeth Process Measurements, Newburgh, N.Y.) interfaced to a Hewlett Packard Computer, Model #9836. The dot gain curve was calculated by using a simple algorithm that included the optical density of the solid patch, the optical density of the paper (gloss) and the optical density of each percent dot area in the Brunner target.

Surface Voltage Measurements. Surface voltage measurements were made before printing and after fifty copies had been made. These measurements were carried out as follows: five 1 inch by 0.5 inch (2.52 cm by 1.27 cm) samples were mounted on a flat aluminum plate that was positioned on a friction free translational stage connected to a solenoid. The five samples were moved from position A to B, about 1 inch (2.54 cm) apart, by activating the solenoid. In position A, they were placed directly under a scorotron for charging. The charging conditions were: 100-200 V grid voltage, 50-200 microamps corona current (4.35 to 5.11 kV) and 2 seconds charging time. After charging was complete, the solenoid was energized and the samples moved to B, away from the scorotron and directly under Isoprobe electrostatic multimeters (Model #174, manufactured by Monroe Electronics, Lyndonville, N.Y.). The outputs from the multimeters were fed into a computer (Model #9836, manufactured by Hewlett Packard, Palo Alto, Calif.) through a data acquisition box (Model #3852A, manufactured by Hewlett Packard, Palo Alto, Calif.) where the voltage versus time was recorded for each sample. Movement of the samples takes about 1 second.

Four Color Proof. A four color proof is obtained by following the steps described below. First, complementary registration marks are cut into the photohardenable layers of the masters prior to exposure. Masters for each of the four color separations are prepared by exposing four photohardenable elements to one of the four color separation negatives corresponding to cyan, yellow, magenta and black colors. Each of the four photohardenable masters is exposed for about 3 seconds using the Douthitt Option X Exposure Unit described above. The visible radiation emitted by this source is suppressed by a UV light transmitting, visible light absorbing Kokomo ® glass filter (No. 400, Kokomo Opalescent Glass Co., Kokomo, Ind.), and the total emitted intensity is reduced by 75% with the use of a 25% transmission screen. The cover sheets are removed, and each master is mounted on the corresponding color module drum, in a position assuring image registration of the four images as they are sequentially transferred from each master to the receiving paper. The leading edge clamps are also used to ground the photohardenable layer aluminized backplane to the drum. The masters are stretched by spring loading the trailing edge assuring that each laid flat against its drum.

Each module comprised a charging scorotron at 3 o'clock position, a developing station at 6 o'clock, a metering station at 7 o'clock and a cleaning station at 9 o'clock. The charging, toning and metering procedure is similar to that described above prior to the examples. The transfer station consists of a tackdown roll, a transfer corona, paper loading, and a positioning device that fixes the relative position of paper and master in all four transfer operations.

Examples 1 and 2 show that photohardenable masters containing a sealant layer maintain their electrical properties better than a master which does not have sealant layer when soaked in a hydrocarbon solvent.

EXAMPLE 1

Following the general procedures, a master was prepared from a composition containing: PSMMA (60.0 g, 60%), TMPEOTA (30.0 g, 30%), 2-MBO (3.0 g, 3.0%), TCTM-HABI (6.2 g, 6.2%), ATU (0.8 g, 0.8%), and TAOBN (0.03 g, 0.03%) dissolved in 400 g of dichloromethane. The master was coated onto 100 μm thick aluminized polyethylene terephthalate film using a 100 μm doctor knife. Coating speed was 4 cm/second. Coating temperature was 80° C. A sheet of polypropylene was laminated to the photohardenable layer. Masters containing sealant layers A, B, and C were prepared as described in the general procedures above.

The master without the sealant layer and the masters with the sealant layers were each exposed through a 50% tint transparency and the voltage retention for each master measured as described in the general procedure. (A 50% tint transparency contains an array of dots which covers 50% of the area.) Then each master was soaked in Isopar ®-L for 0.5 hour and the voltage retention determined after drying. The change in voltage retention is indicated in Table 1 below.

TABLE 1

| Sealant | Voltage Change |
|---|---|
| None | 91 volts |
| A | 10 volts |
| B | 19 volts |
| C | 10 volts |

EXAMPLE 2

Following the general procedures, a master was prepared from a composition containing: PSMMA (53.0 g, 53%), TMPEOTA (27.0 g, 27%), 2-MBO (3.9 g, 3.9%), o-Cl-HABI (13.4 g, 13.4%), DMJDI (1.9 g, 1.9%), ATU (0.8 g, 0.8%), and TAOBN (0.03 g, 0.03%) dissolved in 400 g of dichloromethane. The master was coated onto 100 μm thick aluminized polyethylene terephthalate film using a 100 μm doctor knife. Coating speed was 4 cm/second. Coating temperature was 80° C. A sheet of polypropylene was laminated to the photohardenable layer after drying. Masters containing sealant layers B, C, D, E, F, and G were prepared as described in the general procedures.

The master without the sealant layer and the masters with the sealant layers were each exposed through a 50% tint transparency and the voltage retention for each master measured as described in the general procedure. Then each master was soaked in Isopar ®-L for 0.5 hour and the voltage retention determined after drying. The change in voltage retention is indicated in Table 2 below.

TABLE 2

| Sealant | Voltage Change |
|---|---|
| None | 160 volts |
| B | 4 volts |
| C | 16 volts |
| D | 38 volts |
| E | 6 volts |
| F | 9 volts |
| G | 6 volts[a] |

[a]Control without conductant. Master did not have sufficient contrast for imaging before Isopar ® treatment.

EXAMPLE 3

This example shows that a master containing a sealant layer maintains its electrical properties after 50 copies and after being soaked in hydrocarbon solvent.

Following the general procedures, a master was prepared from a composition containing: PSMMA (60.0 g, 60%), TMPEOTA (30.0 g, 30%), 2-MBO (3.0 g, 3%), TCTM-HABI (6.7 g, 6.7%), ATU (0.3 g, 0.3%), and TAOBN (0.03 g, 0.03%) were dissolved in 400 g of dichloromethane. Masters containing sealant layers D and F were prepared as described in the general procedures.

The master without the sealant layer and masters containing sealant layers D and F were each exposed through a separation transparency and evaluated as described in the general procedure. Exposure was with 50 mJ/cm$^2$; the base side of the transparency was in contact with photosensitive layer, in the case in which no sealant layer was present, or sealant layer of the master during exposure. Image evaluation is given in Table 3 below.

TABLE 3

| Sealant | Dot Range[a] (before) | Dot Range[a] (after) |
|---|---|---|
| None | 1-96 | 1-90 |
| D | 0.5-95 | 1-95 |
| F | 1-96 | 0.5-96 |

[a]Dot range for a 150 dots/inch (60 dots/mm) UGRA target with a resolution range of 0.5-99.5% dots.

The master without the sealant layer and the masters containing sealant layers D and F were each exposed through a 50% tint and the voltage retention for each master measured as described in Example 1. Then each master was soaked in Isopar ®-L for 0.5 hour and the voltage retention determined after drying. The change in voltage retention is indicated in Table 4 below.

TABLE 4

| Sealant | Voltage Change |
|---|---|
| None | 11 volts |
| D | 6 volts |
| F | 9 volts |

EXAMPLE 4

Following the general procedures, a master was prepared from a composition containing: PSMMA (60.0 g, 60%), TMPEOTA (30.0 g, 30%), 2-MBO (3.0 g, 3%), TCTM-HABI (6.2 g, 6.2%), ATU (0.8 g, 0.8%), and TAOBN (0.03 g, 0.03%) were dissolved in 400 g of dichloromethane.

Three masters, one without a sealant layer and two with a sealant layer, were prepared. One sealant layer contained 65% of PSMMA and 35% of TMPEOTA and no charge conductant. The other contained 64.9% of PSMMA, 34.9% TMPEOTA, and 0.2% of ATU. Voltage retained by the master before and after the production of 50 copies was determined as described in the general procedures. The image quality for the first and 50th copies was also determined. These values are given in Table 5 below.

TABLE 5

| Sealant | Dot Range[a] (before) | Dot Range[a] (after) | Voltage Change[b] |
|---|---|---|---|
| None | 4–95 | ND | 25 volts |
| ATU Present | 4–95 | 4–95 | 0 volts |
| No ATU | [c] | | ND |

ND = Not Determined
[a]Dot range on proof using a 150 dots/inch (60 dots/mm) Brunner block target with a resolution range of 4–95% dots.
[b]Change in voltage retention after 50 copies.
[c]No image, only a solid block of color, observed.

EXAMPLE 5

Following the general procedures, a master was prepared as described in Example 4 with the exception that the composition contained: PSMMA (41.4 g, 41.4%), TMPEOTA (23.5 g, 23.5%), Elvacite ®E2659 (15 g, 15%), 2-MBO (0.75 g, 0.75%), TCTM-HABI (8 g, 8%), TL -454 (5.7 g, 5.7%), p-TSA (3 g, 3%), phenidone (0.05 g, 0.05%), TPA (3.2 g, 3.2%), TAOBN (0.02 g, 0.02%) dissolved in 400 g dichloromethane.

Three masters, one without a sealant layer and two with a sealant layer were prepared. One sealant layer contained 65% PSMMA and 35% TMPEOTA and no charge conductant. The other contained 64.9% of PSMMA, 34.9% Igepal ®CA-210, and 0.2% ATU. The image quality for the first and 50th copies were determined as described in Example 4. These values are given in Table 6 below.

TABLE 6

| Sealant | Dot Range[a] (before) | Dot Range[a] (after) |
|---|---|---|
| None | 10–98% | 4–96% |
| No ATU | [b] | [b] |
| ATU Present | 4–97% | 0.5–96% |

[a]Dot range on proof using 150 dots/inch (60 dots/mm) UGRA target with a resolution range of 0.5–99.5%. Film exposed to 70 seconds UV light, 54 mJ/cm$^2$.
[b]Heavy background toning, poor/weak image.

I claim:

1. A high resolution, photohardenable electrostatic master comprising, in order:
   (1) an electrically conductive substrate;
   (2) a photohardenable layer; and
   (3) a sealant layer consisting essentially of a base polymer and a conductant compound selected from the group consisting of a thiourea and a thioamide conductant, said conductant compound being present in sufficient amount to control the discharge characteristics of said sealant layer, such that, following charging of said sealant layer, regions of said sealant layer supra to unexposed regions of said photohardenable layer discharge while regions of said sealant layer supra to exposed regions of said photohardenable layer do not discharge.

2. A photohardenable master according to claim 1 wherein the conductant compound is a thiourea.

3. A photohardenable master according to claim 2 wherein the thiourea compound is of the formula:

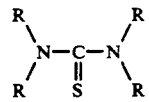

wherein the R groups, which may be the same or different, are hydrogen, alkyl of 1 to 6 carbon atoms, cycloalkyl of 5 to 7 carbon atoms, or aryl of 6 to 10 carbon atoms.

4. A photohardenable master according to claim 3 wherein the thiourea is allyl thiourea.

5. A photohardenable master according to claim 1 wherein the conductive compound is a thioamide.

6. A photohardenable master according to claim 5 wherein the thioamide compound is of the formula:

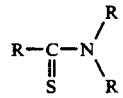

wherein the R groups, which may be the same or different, are hydrogen, alkyl of 1 to 6 carbon atoms, cycloalkyl of 5 to 7 carbon atoms, or aryl of 6 to 10 carbon atoms.

7. A photohardenable master according to claim 6 wherein he thioamide is an aminobutenethioamide.

8. A photohardenable master according to claim 1 wherein the sealant layer additionally contains a plasticizer.

9. A photohardenable master according to claim 8 wherein the conductant is present in an amount of 0.1–5.0% by weight of the sealant layer.

10. A photohardenable master according to claim 8 wherein the sealant layer has a thickness of about 0.001 to about 0.008 millimeter.

11. A photohardenable master according to claim 1 wherein the photohardenable layer comprising:
   (a) an organic polymeric binder,
   (b) an ethylenically unsaturated monomer, and
   (c) a photoinitiator or photoinitiator system that activates polymerization of the ethylenically unsaturated monomer on exposure to actinic radiation.

12. A photohardenable master according to claim 8 wherein the photohardenable layer comprising:
   (a) an organic polymeric binder,
   (b) an ethylenically unsaturated monomer, and
   (c) a photoinitiator or photoinitiator system that activates polymerization of the ethylenically unsaturated monomer on exposure to actinic radiation.

13. A photohardenable master according to claim 11 wherein the photohardenable layer additionally contains a charge decay additive.

14. A photohardenable master according to claim 11 wherein the base polymer of the sealant layer and the polymeric binder of the photohardenable layer are the same material.

15. A photohardenable master according to claim 12 wherein the plasticizer of the sealant layer and the monomer of the photohardenable layer are the same material.

16. A photohardenable master according to claim 15 wherein the plasticizer of the sealant layer and the monomer of the photohardenable layer are each the triacrylate or the trimethacrylate of ethoxylated trimethylolpropane.

17. A photohardenable master according to claim 13 wherein the conductant is a thiourea.

18. A photohardenable master according to claim 17 wherein the thiourea compound is of the formula:

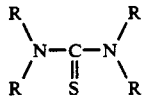

wherein the R groups, which may be the same or different, are hydrogen, alkyl of 1 to 6 carbon atoms, cycloalkyl of 5 to 7 carbon atoms, or aryl of 6 to 10 carbon atoms.

19. A photohardenable master according to claim 18 wherein the conductant compound is allyl thiourea.

20. A photohardenable master according to claim 18 wherein the sealant layer has a thickness of about 0.001 to about 0.008 millimeter.

21. A photohardenable master according to claim 12 wherein the photohardenable layer additionally contains a charge decay additive.

22. A photohardenable master according to claim 21 wherein the base polymer of the sealant layer and the polymeric binder of the photohardenable layer are the same material, the plasticizer of the sealant layer and the monomer of the photohardenable layer are each the triacrylate or trimethacrylate of ethoxylated trimethylolpropane, and the conductant compound is allyl thiourea.

* * * * *